United States Patent [19]

Smith et al.

[11] Patent Number: 4,615,751

[45] Date of Patent: Oct. 7, 1986

[54] EXPLOSIVE WHICH INCLUDES AN EXPLOSIVE EMULSION

[75] Inventors: Jeremy G. B. Smith, Edenvale; Arno W. Dölz, Roodepoort; Carl H. Lübbe, Johannesburg, all of South Africa

[73] Assignee: AECI Limited, South Africa

[21] Appl. No.: 688,156

[22] Filed: Dec. 31, 1984

[30] Foreign Application Priority Data

Feb. 8, 1984 [ZA] South Africa ..... 84/0943

[51] Int. Cl.[4] ..... C06B 45/02

[52] U.S. Cl. ..... 149/2; 149/7; 149/21; 149/46; 149/60; 149/61; 149/76; 149/83; 149/85; 149/109.6

[58] Field of Search ..... 149/2, 7, 46, 60, 61, 149/109.6, 21, 76, 83, 85

[56] References Cited

U.S. PATENT DOCUMENTS

| | | | |
|---|---|---|---|
| 4,111,727 | 9/1978 | Clay | 149/2 |
| 4,181,546 | 6/1980 | Clay | 149/21 |
| 4,294,633 | 10/1981 | Clay | 149/43 X |
| 4,357,184 | 11/1982 | Binet et al. | 149/61 |
| 4,473,418 | 9/1984 | Bampfield et al. | 149/61 |
| 4,490,194 | 12/1984 | Cooper et al. | 149/61 |
| 4,490,195 | 12/1984 | Cooper et al. | 149/61 |
| 4,507,161 | 3/1985 | Sujansky et al. | 149/62 |

FOREIGN PATENT DOCUMENTS

| | | |
|---|---|---|
| 0018085 | 10/1980 | European Pat. Off. . |
| 0028884 | 5/1981 | European Pat. Off. . |
| 1306546 | 2/1973 | United Kingdom . |
| 1536180 | 12/1978 | United Kingdom . |
| 1538092 | 1/1979 | United Kingdom . |
| 1557917 | 12/1979 | United Kingdom . |
| A2050340 | 1/1981 | United Kingdom . |
| A2122983 | 1/1984 | United Kingdom . |
| A2058740 | 1/1984 | United Kingdom . |
| A2129414 | 5/1984 | United Kingdom . |
| 2140404A | 11/1984 | United Kingdom . |

*Primary Examiner*—Stephen J. Lechert, Jr.
*Attorney, Agent, or Firm*—Cushman, Darby & Cushman

[57] ABSTRACT

This invention relates to an explosive. In particular, the invention relates to an explosive of the emulsion type in which an oxidizing salt-containing component forms the discontinuous phase in an emulsion wherein the continuous phase comprises a fuel component which is immiscible with the discontinuous phase.

20 Claims, No Drawings

EXPLOSIVE WHICH INCLUDES AN EXPLOSIVE EMULSION

Such explosives, where the oxidising salt-containing component contains water and is in the form of an aqueous solution, are known as "water-in-fuel emulsions", and when the oxidising salt components include no water, they can be regarded as "melt-in-fuel emulsions".

For bulk applications, emulsion explosives are generally prepared on site when required, and charged directly into boreholes provided in a region of the site to be excavated. These boreholes are generally between 15 cm and 50 cm in diameter and between 10 and 35 m in depth.

The term "borehole" wherever used herein refers to a hole drilled in the ground to accommodate an explosive which can be detonated to excavate the ground in the region of the hole.

In order to increase the explosive power of emulsion explosives, ammonium nitrate prills are added thereto and mixed therewith. Such a mixed emulsion explosive is marketed by AECI Limited as "Energan."

Energan is not water resistant in that the ammonium nitrate prills degrade in the presence of water, and hence the Energan quickly deteriorates in a wet borehole. It is not uncommon that the Energan remains in the boreholes for 24 hours or longer prior to detonation. If the borehole is wet, the Energan usuallly cannot be detonated at all after a 24 hour period.

According to the invention there is provided an explosive, which includes an explosive emulsion comprising a discontinuous phase which includes an oxidising salt and a continuous phase which includes a fuel and which is immiscible with the discontinuous phase;

ammonium nitrate prills; and a water-resisting agent for inhibiting deterioration of the ammonium nitrate prills in the presence of water, which agent has the effect of inhibiting access of water to the ammonium nitrate prills.

The water-resisting agent may be present in a proportion of 0.1 to 10% m/m (mass/mass or weight percent) of the explosive, and may comprise a member selected from the group consisting of petroleum sulphonates; guar gums in conjunction with a cross-linking agents; alkyl phosphates; derivatives of polyisobutylene succinic anhydride; and mixtures of two or more thereof.

For example, a petroleum sulphonate may be that supplied by Witco Corporation of the United States, under the trade name PETRONATE HL; a guar gum may be a product of Trochem (Pty) Ltd supplied under the trade name GUAR EB 940; the alkyl phosphates may be acrylic phosphates obtainable from Croda Chemicals SA (Pty) Ltd; and the derivates of polyisobutylene succinic anhydride may be available as a product of ICI plc which is expected to be obtainable from AECI Limited shortly under the trade name EXPERSE 60.

Without being bound by theory, the Applicant believes that the above-specified water-resisting agents enable a water impermeable layer to be formed around the ammonium nitrate prills, whereby access of water to the ammonium nitrate prills is inhibited.

The emulsion may be formed by dispersing the discontinuous phase in the continuous phase when they are both in liquid form, but the expression "emulsion" is intended to be construed as covering also the emulsions at temperatures below that at which they were formed, so that the discontinuous phase may be a solid.

The oxidising salt of the emulsion component may comprise a member selected from the group consisting of:

alkali metal nitrates,
alkali metal perchlorates,
alkaline earth metal nitrates,
alkaline earth metal perchlorates,
ammonium nitrate,
ammonium perchlorate, and
mixtures of two or more thereof.

The oxidising salt may be present as an aqueous solution.

Instead, the discontinuous phase may comprise ammonium nitrate and one or more compounds which, together with the ammonium nitrate, form a melt which has a melting point which is lower than that of the ammonium nitrate, the compounds being capable of acting as oxygen-releasing salts or fuels.

The fuel may form from about 2 to 25% m/m of the emulsion, preferably being in the region of about 6% to 15% m/m thereof.

The fuel may include an emulsifier which may comprise a member selected from the group consisting of sorbitan sesquioleate, sorbitan monooleate, sorbitan monopalmitate, sorbitan monostearate, sorbitan tristearate, the mono- and di-glycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, polymeric emulsifiers containing polyethylene glycol backbones with fatty acid side chains, and suitable mixtures of two or more thereof.

The fuel will be immiscible with and insoluble in water, and is preferably a non-self-explosive organic fuel, being for example selected from the group consisting of hydrocarbons, halogenated hydrocarbons and mixtures thereof. Thus the fuel may comprise a member selected from the group consisting of mineral oils, fuel oils, lubricating oils, liquid paraffin, microcrystalline waxes, paraffin waxes, xylene, petrolatum, toluene, dinitrotoluene and mixtures of two or more thereof.

In general, when the discontinuous phase contains water, this water should be kept at a minimum consistent with forming a satisfactory emulsion and the prevention of wasted energy arising from steam production upon detonation.

The density of the emulsion should be such as to render it suitably explosive, and is preferably between 1,25 g/ml and 1,45 g/ml at 25° C.

The emulsion may include a density-reducing agent to provide it with the desired density. Preferably chemical gassing may be used to provide a density-reducing agent in the form of gas bubbles for density control and sensitising.

A typical formulation of the emulsion may be

| | percent m/m |
|---|---|
| ammonium nitrate | 66,1 |
| water | 22,6 |
| oil | 10,0 |
| sorbitan monooleate | 1,3 |

An acceptable range of Energan formulations may be

| | percent m/m |
|---|---|
| emulsion | 21,4–50 |
| ammonium nitrate porous prills | 50–78,6 |
| fuel oil | 0–3,6 |

and a typical formulation may be emulsion component: 45 ammonium nitrate porous prills: 55 fuel oil additive: 0 which provides an explosive having a density of 1,29 g/ml.

Although relatively dense ammoniun nitrate prills may be suitable for use in the Energan formulation, the Applicant believes that porous Ammonium nitrate prills are preferable therefor.

The invention extends to a first method of making an explosive which includes an explosive emulsion comprising a discontinuous phase which includes an oxidising salt and a continuous phase which includes a fuel and which is immiscible with the discontinuous phase, and further includes ammonium nitrate prills, the method comprising dispersing, into the pre-formed emulsion, a water-resisting agent for inhibiting deterioration of the ammonium nitrate prills in the presence of water, which water-resisting agent has the effect of inhibiting access of water to the ammonium nitrate prills; and thereafter dispersing the ammonium nitrate prills into the emulsion.

The invention extends to a second method of making an explosive which includes an explosive emulsion, and which comprises a discontinuous phase which includes an oxidising salt and a continuous phase which includes a fuel and which is immiscible with the discontinuous phase, and further includes ammonium nitrate prills, the method comprising dispersing, into the continuous phase, prior to mixing the continuous and discontinuous phases together to form the emulsion, a water-resisting agent for inhibiting deterioration of the ammoniun nitrate prills in the presence of water, which water-resisting agent has the effect of inhibiting access of water to the ammonium nitrate prills;

mixing the continuous and discontinuous phases to one another to form the emulsion; and thereafter dispersing the ammonium nitrate prills into the emulsion.

If desired, a proportion of the water-resisting agent can be dispersed in the continuous phase before the emulsion is formed, and a proportion can be dispersed in the emulsion after it has been formed.

In other words, the first or second method according to the invention may comprise dispersing a proportion of a desired total content of the water-resisting agent in the continuous phase before mixing the continuous and discontinuous phases with one another to form the emulsion, and adding the remainder of the water-resisting agent to the emulsion after formation thereof.

A procedure whereby all of the water-resisting agent is dispersed in the emulsion is exemplified in Examples 1, 5 and 8 below and is referred to hereinafter in a table summarising the examples, as "procedure 1".

A procedure whereby all of the water-resisting agent is dispersed in the continuous phase before mixing the continuous and discontinuous phases with one another to form the emulsion is exemplified in Examples 2, 3, 4, 6 and 9 below, and is referred to hereinafter in the table summarising the examples, as "procedure 2".

A procedure whereby a proportion of the water-resisting agent is dispersed in the continuous phase before mixing the continuous and discontinuous phases with one another to form the emulsion, and the remainder of the water-resisting agent is added to the emulsion before adding the prills to the emulsion is exemplified in Examples 7 and 10 below, and is referred to hereinafter in the table summarising the examples, as "procedure 3".

Where the method includes procedure 3 as abovedescribed, the method may further include adding water to the emulsion after dispersing the remainder of the water resisting agent therein. The Applicant believes that this may promote gelling of particular water-resisting agents such as the guar gums, to provide an explosive with an improved explosive power. Adding 20% to 45% of the water constituent to the continuous phase prior to mixing with the discontinuous phase, and adding the remainder of the water thereafter has been found to be suitable for providing an explosive according to the invention, the total water constituent being typically between 15 and 25% m/m of the emulsion component.

The water-resisting agent as well as the emulsion and the ammonium nitrate prills may be of the types and may be used in the proportions described above.

The method may include adjusting the fuel content of the explosive, for example by adding an oil additive to the emulsion to oxygen balance the resultant explosive. Sufficient oil may be added to achieve an oxygen balance of between +3 and −3 in the resultant explosive. The oil adjustment may conveniently take place when the ammonium nitrate prills are dispersed in the emulsion.

For bulk explosive applications, the emulsion with the water-resisting agent, the ammonium nitrate prills, and, where applicable, the oil used for oxygen balancing, may be stored in separate compartments in a holding tank located at a site where the explosive is required. When the explosive is required, suitable proportions of the contents of the compartments may be fed through an auger and the output thereof fed directly into prepared boreholes.

The following explosives in the form of emulsions was prepared and used as control explosives:

| Control Explosive 1 | |
|---|---|
| constituents of emulsion | percent m/m |
| ammonium nitrate | 66,1 |
| water | 22,6 |
| fuel oil | 10,0 |
| sorbitan monooleate emulsifier ("CRILL 43" supplied by Croda Chemicals SA (Ptyj) Ltd) | 1,3 |

An emulsion was prepared as follows:

(a) The ammonium nitrate was dissolved in the water and the solution which constituted a discontinuous phase was heated up to a temperature of 85° C.;

(b) A continuous phase consisting of the fuel oil and the CRILL 43 was heated up to 85° C.; and (c) The oxidising salt solution was added to the continuous phase and mixed therewith to provide an explosive emulsion having a petroleum-jelly-like consistency and a density of 1,35 g/ml.

Finally porous ammonium nitrate prills were dispersed in the emulsion in the proportion 55% m/m prills: 45% m/m emulsion by mixing to produce an Energan product.

The Energan was stored for 24 hours in a dry environment. Thereafter it was found that a portion of the Energan could be detonated with 60 g of Pentolite booster and the bubble energy (ie a measure of the explosive power) was recorded as 2,35 MJ/kg. A further portion of the Energan could be detonated with 150 g of Pentolite booster and the bubble energy was recorded as 2,45 MJ/kg.

A first and a second transparent cylinder each of 0,5 m length and 0,10 m diameter were filled with water and further portions of the control Energan explosive were thereafter poured into the cylinders to displace about 80% of the water therein and entrain small amounts of water in the explosive. Thus each of the cylinders contained a column of the Energan explosive with water entrained therein and the residual water occupied the upper portion of the cylinder above the explosive.

After 24 hours it could be seen that separation of the components of the explosive had occurred: a large proportion, if not all, of the ammoniun nitrate prills had dissolved and a concentrated ammoniun nitrate solution had collected at the bottom of the cylinders, whilst hydrated emulsion had collected above the said nitrate solution.

The said residual water was poured out of the cylinders and the remaining contents of the cylinders were tipped out into a tin and tested for sensitivity. Neither any fraction of the contents of the first cylinder, nor any fraction of the contents of the second cylinder could be detonated, even with the assistance of a Pentolite booster.

| Control Explosive 2 | |
|---|---|
| constituents of emulsion | percent m/m |
| ammonium nitrate | 72,28 |
| sodium nitrate | 4,50 |
| water | 17,32 |
| fuel oil | 4.90 |
| Crill 43 | 1,00 |

An emulsion was prepared as follows.

(a) The ammonium nitrate and sodium nitrate were dissolved in the water and the solution which constituted a discontinuous phase was heated up to a temperature of 85° C.;

(b) A continuous phase consisting of the fuel oil and the CRILL 43 was heated up to 85° C; and (c) The oxidising salt solution was added to the continuous phase and mixed therewith to provide an explosive emulsion having a petroleum-jelly-like consistency and a density of 1,35 g/ml.

Finally porous ammonium nitrate prills and a fuel oil for oxygen balancing were added to and mixed into the emulsion in the proportion 51,4% m/m prills: 3,6% m/m fuel oil: 45% m/m emulsion, to produce an Energan product.

The Energan was stored for 24 hours in a dry environment. Thereafter it was found that a portion of the Energan could be detonated with 60 g Pentolite booster and the bubble energy (ie a measure of the explosive power) was recorded as 2,35 MJ/kg. A furthr portion of the Energan could be detonated with 150 g of Pentolite booster and the bubble energy was recorded as 2,45 MJ/kg.

The Energan was added to the transparent cylinders as described above for the Control Explosive 1, and after 24 hours the visual result was identical to that of the Control Explosive 1.

As described above in respect of Control Explosive 1, the contents of the cylinders were subsequently tested for sensitivity. Neither any fraction of the contents of the first cylinder, nor any fraction of the contents of the second cylinder could be detonated, even with the assistance of a Pentolite booster.

The invention is now described by way of the following non-limiting examples:

EXAMPLE 1

The emulsion constituents listed above in respect of Control Explosive 1 were used in the proportions as above-specified to prepare an explosive according to the invention as follows.

An emulsion was prepared by (a) dissolving the ammonium nitrate in the water and heating the resulting solution to 85° C. to provide a discontinuous phase;

(b) heating the continuous phase consisting of the fuel oil and the Crill 43 to 85° C.;

(c) mixing the heated continuous and discontinuous phases together to form an emulsion; and (d) mixing 1,0% of a water-resisting agent comprising GUAR EB940 into the emulsion (ie 1 part measured as a proportion of the resultant explosive according to the invention without the sodium dichromate cross-linking agent referred to below).

Thereafter porous ammonium nitrate prills were added to the emulsion prepared according to (a) to (d) above, in the proportion 55% m/m prills: 45% m/m of the emulsion.

Finally, sodium dichromate (a cross-linking agent for the GUAR EB940) was mixed into the emulsion in the proportion 3 ml of 33% solution of sodium dichromate per 2 kg emulsion, to provide an explosive according to the invention.

The density of the resulting explosive was 1,30 g/ml.

This explosive was added to transparent cylinders as described for the Control Explosive 1, and after 24 hours it could be seen that insignificant separation of the explosive components had occured, except for a negligible proportion of the emulsion having collected at the top of the cylinders. The contents of the cylinders were removed therefrom and detonated with 150 g of Pentolite booster, and the bubble energy was recorded as 1,44 MJ/kg.

EXAMPLE 2

The emulsion constituents listed above in respect of Control Explosive 2 were used in the proportions as above-specified to prepare an explosive according to the invention as follows.

An emulsion was prepared by (a) dissolving the ammonium nitrate and sodium nitrate in the water and heating the resultant solution to 85° C. to provide the discontinuous phase;

(b) heating the continuous phase consisting of the fuel oil and the CRILL 43 to 85° C., and dispersing a water-resisting agent comprising 0,45% m/m of PETRONATE HL in the continuous phase (ie 0,45% m/m measured as a proportion of the resultant explosive according to the invention); and (c) mixing the continuous and discontinuous phases together to form an emulsion.

Finally, porous ammonium nitrate prills and fuel oil for oxygen balancing were added to the emulsion prepared according to (a) to (c) above, in the proportion 51,4% m/m prills: 3,6% m/m of the oil additive: 45% m/m of the emulsion, to provide an explosive according to the invention.

This explosive was added to transparent cylinders as described above for the Control Explosive 2, and after 24 hours it could be seen that insignificant separation of the explosive components had occurred, a negligible proportion of the emulsion having collected at the tops of the cylinders.

EXAMPLE 3

The emulsion constituents listed above in respect of Control Explosive 1 were used in the proprtions as above-specified to prepare an explosive according to the invention as follows.

An emulsion was prepared by (a) dissolving the ammonium nitrate in the water and heating the resultant solution to 85° C. to provide the discontinuous phase;

(b) heating the continuous phase consisting of the fuel oil and the CRILL 43 to 85° C., and dispersing a water-resisting agent comprising 0,30% m/m of the alkyl acid phosphate with a high density diester content, in the continuous phase (ie 0,30% m/m measured as a proportion of the resultant explosive according to the invention); and (c) mixing the continuous and discontinuous phases together to form the emulsion.

Finally, porous ammonium nitrate prills were added to the emulsion prepared according to (a) to (c) above, in the proportion 55% m/m prills: 45% of the emulsion, to provide an explosive according to the invention.

This explosive was added to transparent cylinders as described above for the Control Explosive 1, and after 24 hours it could be seen that insignificant separation of the explosive components had occurred, a negligible proportion of the emulsion having collected at the tops of the cylinders.

The contents of the cylinders were removed therefrom and detonated with 150 g of Pentolite booster, and the bubble energy was recorded as 1,7 MJ/kg.

EXAMPLE 4

Example 3 was repeated except that the alkyl phosphate was replaced by 0,45% m/m of EXPERSE 60, measured as a proportion of the resultant explosive according to the invention.

After 24 hours it could be seen that virtually no separation of the explosive components had occurred in the transparent cylinders.

EXAMPLE 5

Example 1 was repeated except that the amount of GUAR EB940 added to the emulsion was reduced to 0,45% m/m, measured as a proportion of the resultant explosive according to the invention without the cross-linking agent.

After 24 hours it could be seen that virtually no separation of the explosive components had occurred in the transparent cylinders.

The contents of the cylinders were detonated with 150 g of Pentolite booster, and the bubble energy was recorded as 2,0 MJ/kg.

EXAMPLE 6

Example 3 was repeated, except that (i) the alkyl phosphate was replaced by 0,40% m/m of GUAR EB940, measured as a proportion of the resultant explosive according to the invention without the sodium dichromate cross-linking agent; and (ii) after adding the ammonium nitrite prills to the emulsion, sodium dichromate was mixed into the emulsion in the proportion 3 ml of 33% solution of sodium dichromate per 2 kg emulsion.

After 24 hours it could be seen that virtually no separation of the explosive components had occurred in the transparent cylinders.

The contents of the cylinders were detonated with 150 g of Pentolite booster, and the bubble energy was recorded as 2,13 MJ/kg.

EXAMPLE 7

The emulsion constituents listed above in respect of Control Explosive 1 were used in the proportions as above-specified to prepare an emulsion according to the invention as follows.

An emulsion was prepared by (a) dissolving the ammonium nitrate in approximately 10% m/m of the water constituent and heating the resultant solution to 85° C. to provide the discontinuous phase;

(b) heating the continuous phase consisting of the fuel oil and CRILL 43 to 85° C., and dispersing a 50% proportion of a water-resisting agent comprising 0,225% m/m of GUAR EB940 into the continuous phase, (ie. 0,225% measured as a proportion of the resultant explosive according to the invention without the cross-linking agent);

(c) mixing the continuous and discontinuous phases together to form the emulsion;

(d) dispersing the remaining 0,225% m/m of the GUAR EB940 into the emulsion; and (e) then mixing the remaining 12,6% m/m of the water into the emulsion.

Thereafter porous ammonium nitrate prills were added to the emulsion prepared according to (a) to (e) above, in the proportion 55% m/m prills: 45% m/m of the emulsion.

Finally sodium dichromate (a cross-linking agent for the GUAR EB940) was mixed into the emulsion in the proportion 3 ml of 33% solution of sodium dichromate per 2 kg emulsion, to provide an explosive according to the invention.

This explosive was added to transparent cylinders as described above for the Control Explosive 1, and after 24 hours it could be seen that virtually no separation of the explosive components had occurred.

The contents of the cylinders were removed therefrom and detonated with 150 g of Pentolite booster, and the bubble energy was recorded as 2,17 MJ/kg.

EXAMPLE 8

Example 1 was repeated, except that the amount of GUAR EB940 added to the emulsion was reduced to 0,90% m/m, measured as a proportion of the resultant explosive according to the invention without the cross-linking agent.

After 24 hours it could be seen that insignificant separation of the explosive components had occurred, a negligible proportion of the emulsion having collected at the tops of the cylinders.

The contents of the cylinders were detonated with 150 g of Pentolite booster, and the bubble energy was recorded as 1,90 MJ/kg.

EXAMPLE 9

Example 6 was repeated, except that the amount of GUAR EB940 was increased to 0,90% m/m, measured as a proportion of the resultant explosive according to the invention without the cross-linking agent.

After 24 hours it could be seen that virtually no separation of the explosive components had occurred in the transparent cylinders.

The contents of the cylinders were detonated with 150 g of Pentolite booster, and the bubble energy was recorded as 2,11 MJ/kg.

EXAMPLE 10

Example 7 was repeated, except that the amount of GUAR EB940 was increased from 0,45 (ie 0,225 and 0,225)% m/m to 0,90 (ie 0,45 and 0,45)% m/m, measured as a proportion of the resultant explosive according to the invention without the cross-linking agent.

After 24 hours it could be seen that insignificant separation of the explosive components had occured, a negligible proportion of the emulsion having collected at the tops of the cylinders.

The contents of the cylinders were detonated with 150 g of Pentolite booster and the bubble energy was recorded as 1,80 MJ/kg.

The examples 1 to 10 above are summarised in the following table

TABLE

| Ex. No. | Water-Resisting Agent (WRA) | Procedure for adding WRA | Amount of WRA in % m/m | Control Explosive to which WRA compared | Visual result after 24 hours in water | Bubble Energy after 24 hours in water MJ/kg |
|---|---|---|---|---|---|---|
| 1 | GUAR EB940 | 1 | 1,00 | 1 | Good | 1,44 |
| 2 | PETRONATE HL | 2 | 0.45 | 2 | Good | not measured |
| 3 | ALKYL ACID PHOSPHATE | 2 | 0,30 | 1 | Good | 1,7 |
| 4 | EXPERSE 60 | 2 | 0,45 | 1 | Excellent | not measured |
| 5 | GUAR EB940 | 1 | 0,45 | 1 | Excellent | 2,0 |
| 6 | GUAR EB940 | 2 | 0,40 | 1 | Excellent | 2,13 |
| 7 | GUAR EB940 | 3 | 0,225/0,225 | 1 | Excellent | 2,17 |
| 8 | GUAR EB940 | 1 | 0,90 | 1 | Good | 1,90 |
| 9 | GUAR EB940 | 2 | 0,90 | 1 | Excellent | 2,11 |
| 10 | GUAR EB940 | 3 | 0,45/0,45 | 1 | Good | 1,80 |

NB
1. Amount of water-resisting agent is given in % m/m of resultant explosive according to the invention excluding the cross-linking agent.
2. Although in instances where GUAR EB940 was used, 0,5 g of a 33% solution of sodium dichromate were used to effect cross-linking, the Applicant believes that an appropriate proportion of any other suitable cross-linking agent could have been used (eg the sodium dichromate cross-linking agent could have been replaced with potassium pyroantimonate) to provide similar results.
3. The visual result is graded inversely according to the extent of separation of the components of the explosive according to the invention in water, no separation or virtually no separation being graded as "excellent".

The visual results showed clearly that the extent of separation in water of the components of the explosive of the Examples was virtually non existent, or at least negligible compared to the separation visible with the control explosives in water. Where there are no or negligible visible separation of the components of the explosives in water, there was no apparent major reduction in the explosive power thereof. In face, it is clear from the recorded bubble energies that explosives according to the invention after 24 hours in water realise a large portion of their potential bubble energy when dry.

We claim:

1. An explosive which includes 21.4–50% m/m of an explosive emulsion comprising a discontinuous phase which includes an oxidizing salt and a continuous phase which includes a fule and which is immiscible with the discontinuous phase; 50–78.6% m/m ammonium nitrate prills; and a water-resisting agent for inhibiting deterioration of the ammonium nitrate prills in the presence of water with which the explosive may come in contact during use, which agent has the effect of inhibiting access of water to the ammonium nitrate prills, the prills being dispersed in and surrounded by the emulsion and the water-resisting agent.

2. An explosive as claimed in claim 1, wherein the water-resisting agent comprises a member selected from the group consisting of petroleum sulphonates; guar gums in conjunction with a cross-linking agents; alkyl phosphates; derivatives of polyisobutylene succinic anhydride; and mixtures of two or more thereof.

3. An explosive as claimed in claim 1, wherein the water-resisting agent is present in a proportion of 0.1 to 10% m/m of the explosive.

4. An explosive as claimed in claim 1, wherein the oxidising salt comprises a member selected from the group consisting of alkali metal nitrates,
alkali metal perchlorates,
alkaline earth metal nitrates,
alkaline earth metal perchlorates,
ammonium nitrates,
ammonium perchlorates, and
mixtures of two or more thereof.

5. An explosive as claimed in claim 1, wherein the oxidising salt is present in an aqueous solution.

6. An explosive as claimed in claim 1, wherein the discontinuous phase includes ammonium nitrate and a compound which, together with the ammonium nitrate, forms a melt which has a melting point which is lower than that of the ammonium nitrate, the compound being capable of acting as an oxygen releasing salt or fuel.

7. An explosive as claimed in claim 1, wherein the fuel of the continuous phase forms 2 to 25% m/m of the emulsion.

8. An explosive as claimed in claim 1, wherein the fuel of the continuous phase is organic and non-self-explosive.

9. An explosive as claimed in claim 8 wherein the fuel of the continuous phase includes a member selected from the group consisting of mineral oils, fuel oils, lubricating oils, liquid paraffin, micro-crystalline waxes, paraffin waxes, xylene, petrolatum, toluene, dinitrotoluene, and mixtures of two or more thereof.

10. An explosive as claimed in claim 1, wherein the fuel of the continuous phase includes an emulsifier.

11. An explosive as claimed in claim 10 wherein the emulsifier comprises a member selected from the group consisting of sorbitan sesquioleate, sorbitan monoleate, sorbitan monopalmitate, sorbitan monostearate, sorbitan tristerate, the mono- and di-glycerides of fat-forming fatty acids, soya bean lecithin, derivatives of lanolin, alkyl benzene sylphonates, oleyl acid phosphate, laurylamine acetate, decaglycerol decaoleate, decaglycerol decasterates, polymeric emulsifiers containing polyethylene glycol backbones with fatty acid side chains, and suitable mixtures of two or more thereof.

12. An explosive as claimed in claim 1, wherein the density of the explosive is from 1,25 g/ml to 1,45 g/ml at 25° C.

13. An explosive as claimed in claim 1, which includes a density-reducing agent in the form of gas bubbles.

14. A method of making an explosive which includes 21.4–50% m/m of an explosive emulsion, comprising a discontinuous phase which includes an oxidising salt and a continuous phase which includes a fuel and which is immiscible with the discontinuous phase, and further includes 50–78.6% m/m ammonium nitrate prills, the method comprising dispersing, into the pre-formed emulsion, a water-resisting agent for inhibiting deterioration of the ammonium nitrate prills in the presence of water with which the explosive may come in contact during use, which water-resisting agent has the effect of inhibiting access of water to the ammonium nitrate prills; and thereafter dispersing the ammonium nitrate prills into the emulsion so that the prills are dispersed in and surrounded by the emulsion and the water-resisting agent.

15. A method of making an explosive which includes 21.4–50% m/m of an explosive emulsion, and which comprises a discontinuous phase which includes an oxidising salt and a continuous phase which includes a fuel and which is immiscible with the discontinuous phase, and further includes 50–78.6% m/m ammonium nitrate prills, the method comprising dispersing, into the continuous phase, prior to mixing the continuous and discontinuous phase together to form the emulsion, a water-resisting agent for inhibiting deterioration of the ammonium nitrate prills in the presence of water, which water-resisting agent has the effect of inhibiting access of water to the ammonium nitrate prills; mixing the continuous and discontinuous phase to one another to form the emulsion; and thereafter dispersing the ammonium nitrate prills into the emulsion so that the prills are dispersed in and surrounded by the emulsion and the water-resisting agent.

16. A method as claimed in claim 14 or claim 15, which includes dispersing a proportion of a desired total content of the water-resisting agent in the continuous phase before mixing the continuous and discontinuous phases with one another to form the emulsion, and adding the remainder of the water-resisting agent to the emulsion after formation thereof.

17. A method as claimed in claim 16, which includes adding water to the pre-formed emulsion after dispersing the remainder of the water-resisting agent therein.

18. A method as claimed in claim 14 or claim 15 which includes adjusting the fuel content of the explosive to oxygen balance the explosive.

19. An explosive as in claim 1 containing at least 55% of ammonium nitrate prills.

20. A method as in claim 14 or 15 wherein the explosive contains at least 55% of ammonium nitrate prills.

* * * * *